United States Patent [19]

Sawase et al.

[11] Patent Number: 4,567,804

[45] Date of Patent: Feb. 4, 1986

[54] AUTOMATIC PLAYING MUSICAL INSTRUMENT

[75] Inventors: Takamichi Sawase; Akinori Endo, both of Hamamatsu, Japan

[73] Assignee: Nippon Gakki Seizo Kabushiki Kaisha, Hamamatsu, Japan

[21] Appl. No.: 716,594

[22] Filed: Mar. 27, 1985

Related U.S. Application Data

[63] Continuation of Ser. No. 442,128, Nov. 16, 1982, abandoned.

[30] Foreign Application Priority Data

Nov. 20, 1981 [JP] Japan ..... 56-186560

[51] Int. Cl.[4] ..... G10F 5/00; G10G 3/04

[52] U.S. Cl. ..... 84/115; 84/462

[58] Field of Search ..... 84/1.1, 1.27, 1.28, 84/115, 462, DIG. 29

[56] References Cited

U.S. PATENT DOCUMENTS

| | | | |
|---|---|---|---|
| 3,865,002 | 2/1975 | Shimizu et al. | 84/DIG. 29 |
| 3,955,459 | 5/1976 | Mochida et al. | 84/115 X |
| 4,023,456 | 5/1977 | Groeschel | 84/115 |
| 4,224,644 | 9/1980 | Lewis et al. | 360/72.2 |
| 4,413,292 | 11/1983 | Sugiyama et al. | 360/72.2 |

FOREIGN PATENT DOCUMENTS 2032162 4/1980 United Kingdom ..... 84/115

*Primary Examiner*—William B. Perkey

*Attorney, Agent, or Firm*—Spensley Horn Jubas & Lubitz

[57] ABSTRACT

An automatic playing musical instrument is provided in which the amount of storage medium to be used is substantially decreased. The automatic playing musical instrument is provided with a key information generating circuit for generating key information corresponding to a depressed key among the plurality of keys. A change of the key information is then detected, and a time interval between one of the change and the other which follows immediately after the one of the change is measured so as to generate a time period data representative of the time interval. Each time the change is detected, a musical performance data comprising the key information and the time period is stored in the storage medium, while on the other hand if the change is not detected, no musical performance data is stored thereby saving the amount of the storage medium to be used. The musical performance data stored in the storage medium is reproduced by supplying it to a driving circuit which drives the corresponding key in accordance with the musical performance data.

12 Claims, 14 Drawing Figures

AUTOMATIC PLAYING MUSICAL INSTRUMENT

This application is a continuation of U.S. application Ser. No. 442,128 filed Nov. 16, 1982 and now abandoned.

BACKGROUND OF THE INVENTION (a) Field of the Invention

The present invention relates to an automatic playing musical instrument capable of playing such as a piano or the like in accordance with a data which has previously been prepared by storing musical tones produced by a player in a suitable storage device.

(b) Description of the Prior Art

FIG. 1 is a diagrammatic illustration of a prior art automatic piano playing instrument showing briefly a construction thereof. In the figure, a reference numeral 1 denotes a key of a piano which is pivoted about a fulcrum 2 in such a way that an end portion 1*b* of the key 1 is moved upward when an operating portion 1*a* opposite to the end portion 1*b* is depressed downward. The upward movement of the end portion 1*b* is transmitted to a piano action 3 which actuates a hammer 4 to strike a string 5.

By depressing the operating portion 1*a* of the key 1, a key switch 8 comprising a flexible spring 6 and a contact point 7 is turned on. Musical tones produced by the string 5 are received by a microphone 9 for the transference thereof to a record control circuit 10, one or two microphones 9 being commonly used for one piano. The record control circuit 10 detects whether each of all the keys 1 is depressed or not sequentially in response to an output from the corresponding keyswitch 8 thereby periodically delivering a key data which represents each key is depressed or not to such a data recorder 11 as a cassette tape recorder. Simultaneously, the record control circuit 10 detects the strength of a key striking motion in accordance with an output from the microphone 9 thereby delivering a key striking stength data representative of the strength of a key striking motion to the data recorder 11. The data recorder 11 is activated (or the magnetic tape thereof is started to move) at the start of playing the piano in order to record sequentially the aforementioned key data and key striking strength data.

The above steps are concerned with the recording of a musical performance data generated by a player. Conversely, when the recorded musical performance data is requested to be reproduced, the data recorder 11 transfers sequentially in real time the recorded data to a reproduction logical circuit 12. In the circuit 12, a key data and a key striking strength data are reproduced in accordance with the data from the data recorder 11 for the delivery to a solenoid driving circuit 13. The solenoid driving circuit 13 generates a solenoid driving signal in accordance with the key data and key striking strength data supplied thereto, the solenoid driving signal being supplied to a solenoid 14 identified by the key data. Then, the plunger 14*a* of the solenoid 14 is driven upward with a speed corresponding to the key striking strength data, thereby urging the end portion 1*b* of the key 1 to move upward with the upper end of the plunger 14*a* being in contact relation to the bottom surface of the key 1 adjacent to the end portion 1*b*. The upward displacement of the end portion 1*b* is transformed via the piano action 3 into the striking motion of the hammer 4, thereby striking the string 5 with a force corresponding to the key striking strength data.

One of typical conventional automatic piano playing instruments has been described above in brief. Such automatic piano playing instruments have been found not entirely satisfactory, however, in the following points:

(1) Since the musical performance data relating to all the keys is being recored constantly, a considerable amount of storage medium (magnetic tape) is required: The constant recording of the musical performance data on the storage medium is somewhat ineffective in a sense that even when the musical performance data does not change its contents, i.e., when the same key data and key striking strength data are maintained during a certain period, these same data must be sequentially recorded on the storage medium until that period terminates.

(2) Since the key striking strength data is generated in accordance with the output from the microphone 9, particularly when a plurality of keys are concurrently depressed, the data of particular one of the keys can not be discriminated from the output representing the data of all of the plurality of depressed keys. Consequently, it is difficult to reproduce the musical performance with high fidelity.

Apart from the above primary problems, some inconveniences have been pointed out when a storage medium other than the magnetic tape is used for the automatic playing musical instrument: the musical performance data stored in the magnetic tape can be fast-forwarded or rewound (fast-backward) with such a speed as a person can easily control or recognize the amount of the data proceeded or receded. However, in the case of the musical performance data stored in such as a floppy disk, although a high speed proceeding or receding of the data can be attained in proportion to the rotational speed of the floppy disk, no proper measures to control adequately the amount of the data, or to decrease the speed of the data to be proceeded or receded to a more practical and recognizable one, have been proposed to date. Furthermore, effective retrieval of one of the plural pieces of music stored in the stroage medium has long been desired in this field of technology.

SUMMARY OF THE INVENTION

It is therefore a principal object of the present invention to provide a novel automatic playing musical instrument in which the amount of storage medium to be used is substantially decreased and each of the key striking strength data is recorded separately and independently.

It is another object of the present invention to provide the automatic playing musical instrument as above in which the speed of the data to be proceeded or receded is decreased to a more practical and recognizable one.

It is a further object of the present invention to provide the automatic playing musical instrument as above in which an effective retrieval of one of the plural pieces of music stored in the storage medium can readily be attained.

In a preferred example of the present invention which will be described hereinunder in detail, the automatic playing musical instrument comprises: a plurality of keys; key information generating means for generating key information corresponding to a depressed key among the plurality of keys; change detecting means for detecting a change of the key information; measuring means for measuring a time interval between one of the change and the other which follows immediately after the one of the change and generating a time period data representative of the time interval; storing means for storing, each time the change is detected, a musical performance data comprising the key information and the time period data; and driving means for driving the key corresponding to the musical performance data.

The foregoing and other objects, the features and the advantages of the present invention will be pointed out in, or apparent from, the following description of the preferred ambodiments considered together with the accomanying drawins.

DETAILED DESCRIPTION OF THE PREFERRED EMBODIMENT

Figure 2:
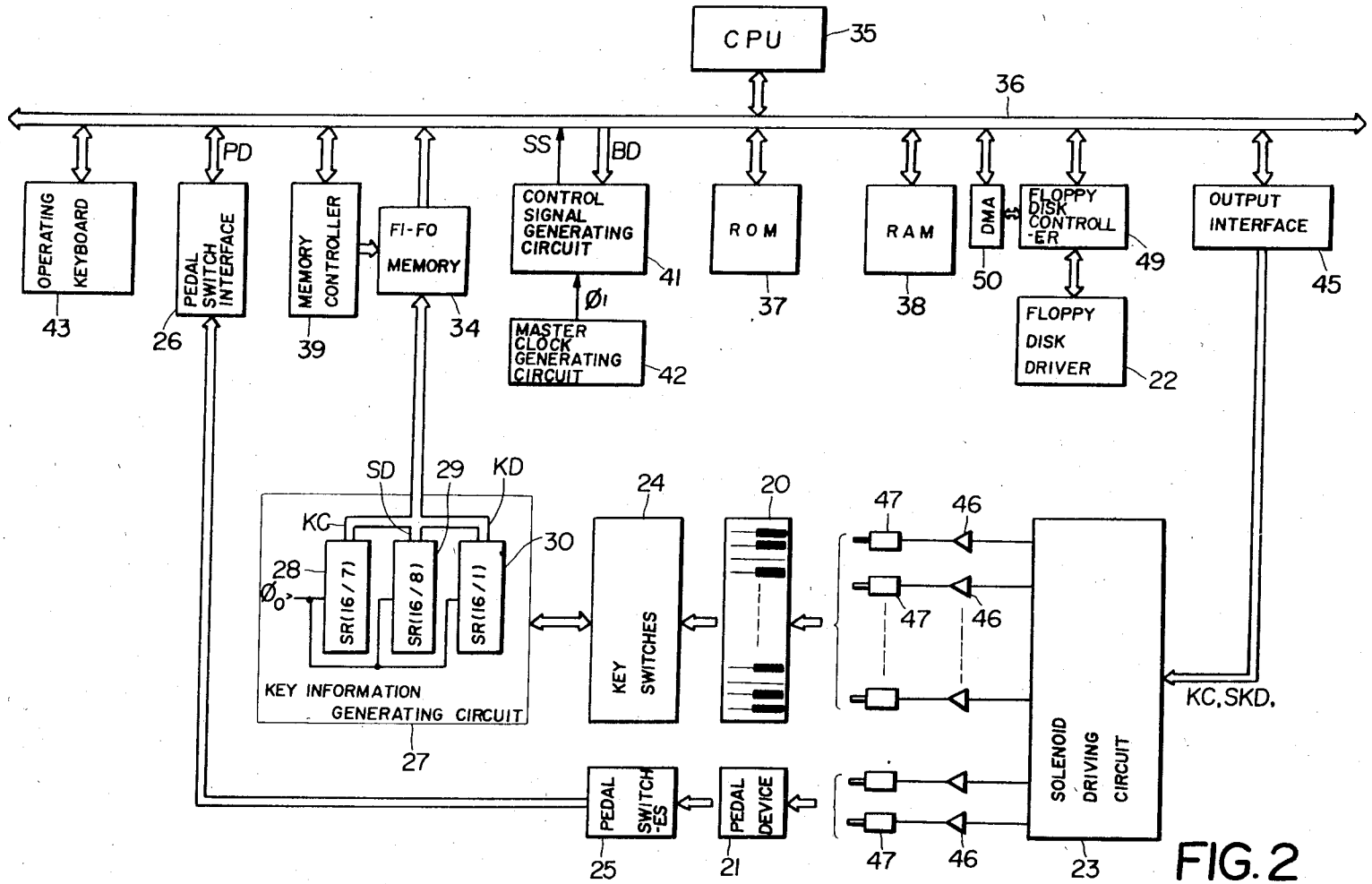
FIG. 2 is a block diagram showing an arrangement of an embodiment according to the present invention.

A preferred embodiment according to the invention will now be described with reference to the accompanying drawings. Referring now to FIG. 2 which shows a schematic block diagram illustrating an arrangement of the automatic playing musical instrument, more particularly, the automatic piano playing instrument, a brief description thereof is first given.

Figure 1:
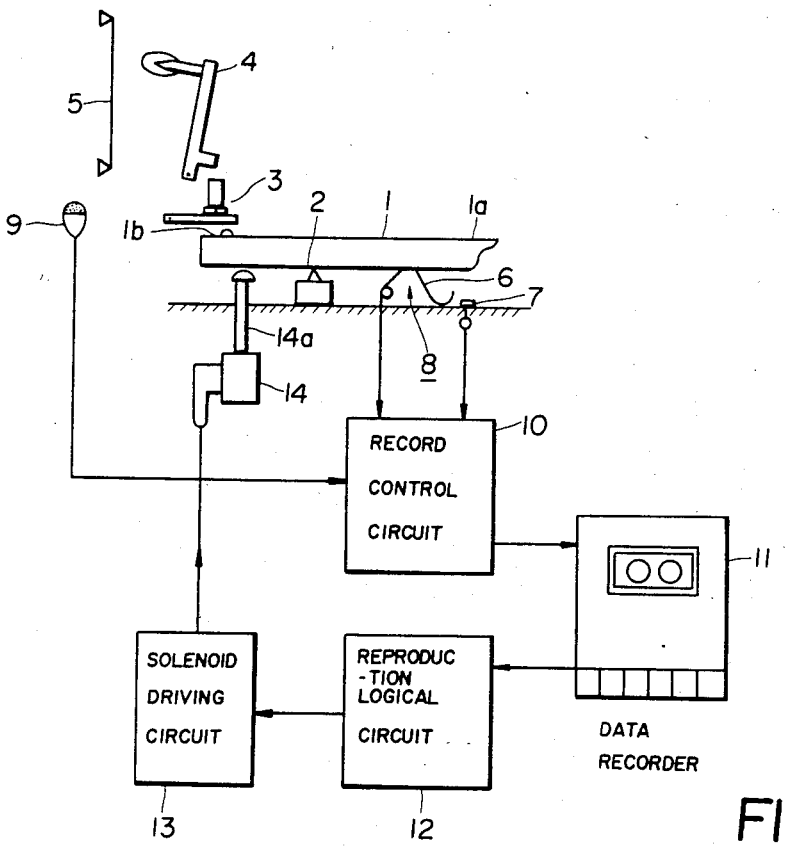
FIG. 1 PRIOR ART
FIG. 1 is a diagrammatic illustration showing a brief construction of a prior art automatic piano playing instrument.

Each key of a keyboard 20 is provided with two key switches and a solenoid 47 (similar to that shown in FIG. 1 by a reference numeral 14) for driving a key. The respective two key switches are actuated in a different timing upon depression or release of the key (as described later in detail). Damper and sostenuto pedals (shown collectively as a pedal device 21) of the piano are provided with respective pedal switches 25 and solenoids 47 for actuating the pedals. The depression and release of the key is detected in accordance with the output from the corresponding key switch, the speed of movement of the key, i.e., the key striking strength is detected in accordance with the time interval between the actuation of the two key switches, and the depression and release of the pedal is detected in accordance with the output from the corresponding pedal switches. Data obtained from the operation of the above key and pedal switches is used for generating a musical performance data which is written to available tracks of a floppy disk stowed in a floppy disk driver 22. In order to reproduce the musical performance data (or to play a piano automatically), the musical performance data stored in the floppy disk is sequentially read out therefrom and is converted into another form suitable for being supplied to a solenoid driving circuit 23. The solenoid of each key and pedal is therefore driven in accordance with the data delivered from the solenoid driving circuit 23, thereby enabling to automatically play the piano.

The more detailed description of the automatic piano playing instrument will now be given hereinunder.

Figure 3:
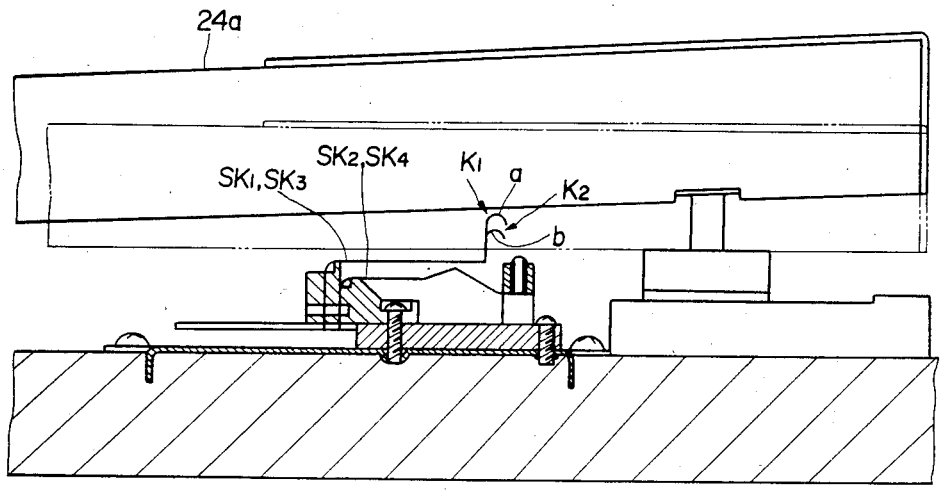
FIG. 3 is a side sectional view showing a construction of key switches Kl and K2 provided on each key of the piano keyboard.

In FIG. 2, key switches 24 shown as a block comprise a plurality of key switches provided to each key of the keyboard 20. Referring particularly to FIG. 3, an example of the construction of the two key switches provided to the respective single key will be described. In the figure, a reference numeral with a suffix 24*a* denotes one of the keys of the keyboard 20. First and second key switches Kl and K2 are arranged under the front portion of the key 24*a* in a juxtaposed relation to each other. The first and second key switches K1 and K2 comprise respective movable contacts SK1 and SK3, and respective fixed contacts SK2 and SK4 disposed under and adjacent to the contacts SK1 and SK3. The movable contacts SKl and SK3 are fixed at one ends thereof and extending thereform in the longitudinal direction of the key 24*a*. At the other ends of the movabe contacts SKl and SK3, there are provided contact sections (a) and (b) which are bent generally in a form of an inverted J character for engagement with the bottom of the key 24a. The contact section (a) is positioned at a higher level than the contact section (b), i.e., the former is positioned nearer to the bottom of the key 24*a* than the latter. As a result, when the key 24*a* is depressed, the contact section (a) is first lowered by the bottom of the key 24*a* so that it comes into contact with the fixed contact SK2 and causes the first key switch K1 to turn on, thereafter the contact section (b) is lowered by the further downward movement of the bottom of the key 24*a* so that it also comes into contact with the fixed contact SK4 and causes the second key switch K2 to turn on.

Pedal switches 25 shown in FIG. 2 comprises two pedal switches provided to each pedal of the pedal device 21, the output of each pedal switch being supplied to a pedal switch inerface 26.

A key information generating circuit 27 scans each key switches Kl and K2 of the key switches 24 in order to detect on-off states thereof, and generates key information in accordance with the on-off states of the key switches K1 and K2. The key information is composed of a key code KC (7 bits), key striking strength data SD (8 bits), and key depression acknowledging code KD (1 bit). More in detail, the key information generating circuit 27 comprises three shift registers 28 (16 stages/7 bits), 29 (16 stages/8 bits) and 30 (16 stages/1 bit), each register being driven and controlled by a clock pulse $\phi$. When any one (hereinafter referred to as key A where applicable) of the keys is depressed and the first key switch Kl corresponding to the key A is turned on, the key code KC corresponding to the key A is written to an empty stage (assuming here that the empty stage is the tenth stage among the sixteen stages) of the shift register 28. After the first key switch Kl of the key A is turned on, the time interval, until the second key switch K2 is turned on, is measured. The measured result is used as the key striking strength data SD and is written to the tenth stage of the shift register 29. Concurrently when the second key switch K2 of the key A is turned on, the key depression acknowledging code KD (a logical signal of "1") is written to the tenth stage of the shift register 30. When the key A is released and the first key switch Kl is restored to an off state, all of the contents in the tenth stages of each shift register 28 through 30 are cleared (or made "0").

As readily understood from the construction of the shift registers 28, 29 and 30 each having sixteen stages, the key information generating circuit 27 has a capability to assign the key information of sixteen keys at the maximum to respective stages of the shift registers 28 through 30. The key information thus assigned to respective stages of the shift registers 28 through 30 is transferred to a first-in first-out momory FIFO 34 in a time division manner under control of the aforementioned clock pulse $\phi$. In order to obtain the key striking strength data SD, the following process is carried out.

Taking the same situation as one example in which the key A is depressed and the first key switch Kl is turned on, then a logical value "1" is sequentially added at each of certain time intervals to the tenth stage of the shift register 29. (All of the contents of the tenth stage of the shift register 29 are previously set to be "0" at the instant the first key switch Kl of the key A is turned on). The above addition of "1" is terminated at the time the second key switch K2 is turned on, thereafter during the period the key A is retained being depressed, the added result in the tenth stage of the shift register 29 is outputted as the key striking strength data SD. The contents of the shift register 29, until the second key switch K2 is turned on, does not indicate the correct key striking strength data SD, but the contents merely represent an intermediately measured time interval between the actuation of both key switches K1 and K2. The correct key striking strength data SD can only be outputted from the shift register 29 only after the second key switch K2 is turned on, or in other words only after the key depression acknowledging code KD is rendered to be "1".

A central processing unit 35 (an abbreviation CPU is used hereinafter) controls all the other devices connected thereto via a bus line 36 in accordance with a program to perform specified activities described later.

Figure 4:
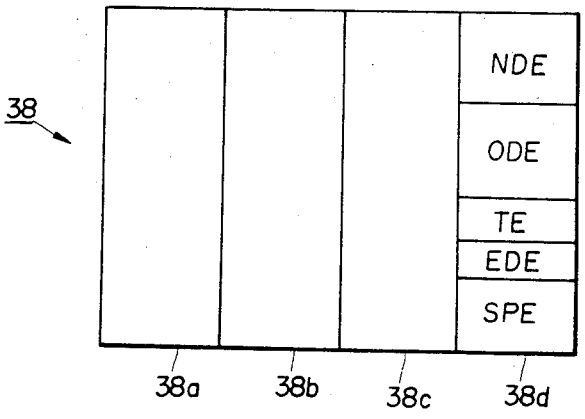
FIG. 4 shows a memory map of the RAM 38 illustrated in FIG. 2.

A ROM (Read-only Memory) 37 is a storage device in which programs for use in the CPU 35, conversion and correction tables for key striking strength data described later, are stored. A RAM (Random Access Memory) 38 as best shown in FIG. 4 has a capacity of 16K words and is divided into four areas 38*a* through 38*d*, each having a storage capacity of 4K words. The areas 38*a* through 38*c* are used for serving as buffer memories when a read/write operation for the floppy disk driver 22 is performed, while the area 38*d* is used for serving as work area.

The FIFO memory 34 is constructed as a 16×16 bit first-in first-out memory, the read/write operation of which is controlled by a memory controller 39. Upon receipt of a write command from the CPU 35, the memory controller 39 makes the FIFO memory 34 in an enable state for a write operation. Thus, all the contents contained in the shift registers 28 through 30 of the key information generating circuit 27 are transferred to and written onto the FIFO memory 34 in synchronization with the clock pulse $\phi$. Similarly, upon receipt of a read command from the CPU 35, the memory controller 39 makes the FIFO memory 34 in another enable state for a read operation. Thus, all the contents stored in the FIFO memory 34 are transferred to and written onto a new data area NDE of the area 38*d* of the RAM 38. The reason of the insertion of the FIFO memory 34 between the key information generating circuit 27 and the bus line 36 is originated from the fact that the CPU 35 and key information generating circuit 27 are independently controlled by different (or not synchronized) clock pulses.

The pedal switch interface 26 is a circuit which generates a pedal data PD in correspondence with a detected on/off state of each pedal switch of the pedal switches 25.

A control signal generating circuit 41 counts a 2 MHz clock plulse $\phi$ supplied from a master clock generating circuit 42 in accordance with a repetition data BD from the CPU, thereby generating a control signal SS which is delivered to the CPU 35 via the bus line 36. The time interval of the control signal SS is generally determined to be 4 ms (mil seconds), however, other time intervals such as 3.5 ms, 3 ms, or 200 $\mu$s (micro-seconds) may be used when occasion demands.

An operating keyboard 43 comprises a start switch, a stop switch, write/read command switches for the floppy disk driver 22, numeric character keys for identifying the code of a music, and other similar levers or buttons on the keyboard to be depressed manually, the output from each switch, key or the like being encoded and transferred to the bus line 36.

The solenoid driving circuit 23 generates a solenoid driving signal in accordance with a solenoid driving data SKD transferred from the CPU 35 via the bus line 36 and an output interface 45, the solenoid driving signal having a constant time interval between each pulse, the width of which varies in accordance with the solenoid driving data SKD. The solenoid driving signal is supplied via an appropriate amplifier 46 to a solenoid 47 which is identified by the key code KC or pedal data PD transferred from the CPU 35.

Next, the operation of the automatic piano playing instrument thus constructed will be described hereinunder.

(I) Musical Performance Data Recording

A musical performance data to be produced by a player is stored in the floppy disk of the floppy disk driver 22 in such a way as in the following. The player actuates the write command switch on the operating keyboard 43 and then depresses the start switch in order to make the automatic piano playing instrument ready for being played. The player can then play music in a conventional way by using keys and pedals of the keyboard 20 and pedal device 21. When a first musical program is completed, the player depresses the stop switch on the operating keyboard 43. Similarly, when a second musical program is desired to be carried out, the player must depress the start switch again prior to the musical performance, and depresses the stop switch after competion of the second program.

Upon depression of the start switch, the CPU 35 delivers the repetition data BD instructing the control signal generating circuit 41 to generate the control signal SS having a 4 ms time interval. The CPU 35 controls the following processes upon reception of each control signal SS.

(a) First, a write instruction is supplied from the CPU 35 to the memory controller 39 to initiate the transfer operation of all the contents of the shift registers 28 through 30 in the key information generating circuit 27 to the FIFO memory 34.

(b) The transferred data in the FIFO memory 34 is then written to the new data area NDE within the area 38*d* of the RAM 38.

(c) At the next stage, the pedal data PD from the pedal switch interface 26 is transferred and written to the new data area NDE within the same area 38*d* of the RAM 38.

(d) A logical value "1" is added to the contents of the data stored in the timer area TE within the area 38*d* of the RAM 38. What this operation means will be described later more specifically.

(e) Next, the data stored in the new data area NDE of the RAM 38 is compared with that in an old data area ODE in order that a change (hereinafter referred to as "event") can be detected when the performing conditions, i.e., the depression and release of the key and pedal, of the keyboard 20 and pedal device 21 differ from the previous conditions. The old data area ODE functions to store temporarily the contents of the shift registers 28 through 30 and the pedal data PD, both of them having previously been transferred thereto in response to the preceding control signal SS generated 4 ms before.

The detailed description of the event detection is given hereinunder. First, with respect to the pedal device 21, an event is detected when there is any change in the pedal data PD. However, with respect to the keyboard 20, an event is not detected when only the first key switch Kl is turned on, but with the condition that the second key switch K2 is also turned on, i.e., when the key depression acknowledging code KD is rendered to be "1", an event is detected. More precisely an event is detected at the instant when a new control signal SS is generated after generation of the "1" signal of the key depression acknowledging code KD. In the case of a key release, an event is detected when the first key switch Kl is turned off with the result that the key code KC and key depression acknowledging code KD are restored to "0" in the contents. More precisely, an event is detected at the instant when a new control signal SS is generated after the first key switch Kl is turned off.

(f) In the case when the event is not detected during the above stage (e), the contents of the new data area NDE of the RAM 38 is transferred to the old data area ODE to terminate a processing of the consecutive stages described above and to wait for the next control signal SS.

Figure 5:
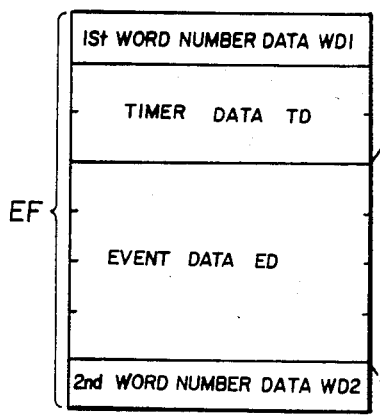
FIG. 5 shows a construction of an event frame EF incorporated into the present invention.

(g) In the case when the event is detected during the above stage (e), a format comprising a series of data (hereinafter designated as an event frame EF) specifically shown in FIG. 5 is made and written to the area 38*a* of the RAM 38. The event frame EF is described later in detail.

(h) Thereafter, the contents of the timer area TE is cleared.

(i) Then, the contents of the new data area NDE is transferred to the old data area ODE to terminate a processing of the consecutive stages described above and to wait for the next control signal SS.

The operations to be carried out every time the control signal SS is generated have been described with reference to the control by the CPU 35. Now, the data to be stored in the timer area TE as well as the event frame EF is discussed below.

The data stored in the timer area TE is cleared every time an event is detected as described in the above stage (h), and a logical value "1" is added to the timer area TE every time the subsequent control signal SS is generated. The data stored in the timer area TE at the time of the generation of the control signal SS indicates the time period from the instant of the generation of the previous event to the instant of the generation of the next event, thus the time period being an integral multiple of the time interval 4 ms of the control signal SS.

The event frame EF as specifically shown in FIG. 5 comprises a first word number data WDl, timer data TD, event data ED, and second word number data WD2. The description of these data is given in this order hereinunder.

(a) First Word Number Data WDl

The contents of the first word number data WDl is indicative of a total of the number of words of the timer data TD and event data ED.

(b) Timer Data TD

The timer data TD stored in the timer area TE of the RAM 38, at the time of the processing of the above stage (g), indicates a time period from the generation of the previous event to that of the present event. The timer data TD is formed to have a two-word arrangement.

(c) Event Data ED

Figure 6:
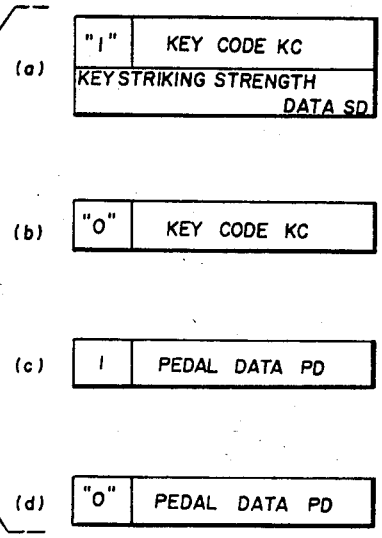
FIGS. 6*a* through 6*d* show respectively examples of a format of the event frame EF.

The event data ED is the data concerning a key or pedal for which an event is detected. When a key is newly depressed and the second key switch K2 is turned on, an event data ED of a two-word arrangement is generated which includes, as shown in FIG. 6(*a*), a key code KC (7 bits), and key striking strength data SD (8 bits) of the newly depressed key, and key-on code or key depression acknowledging code "1". As previously described, the key code KC and key striking strength data SD are located in the new data area NDE. When a key is released, as shown in FIG. 6(*b*), an event data ED of a one-word arrangement is generated which includes a key code KC of the released key, and key-off code "0". When any one of the pedals of the pedal device 21 is turned on, as shown in FIG. 6(*c*), an event data ED of one-word arrangement is generated which includes a pedal data PD, and pedal-on code "1". While on the other hand, when a pedal is turned off from its previous on-state, as shown in FIG. 6(*d*), an event data ED of a one-word arrangement is generated which includes a pedal data PD, and pedal-off code "0". Further, when two keys are depressed simultaneously at a time, an event data ED having two event data each having a similar format as shown in FIG. 6(*a*) is generated. Similarly, when a key and a pedal are depressed simultaneously an event data ED having those shown in FIGS. 6(*a*) and 6(*c*) is generated. The timer data TD and event data ED are designated collectively as a musical performance data, as already described.

(d) Second Word Number Data WD2

This data is identical in the contents to the first word number data WDl. Thus, in this preferred embodiment, the same data indicative of the same word number is allocated both at the start and end of the format of the event frame EF.

A more concrete description of the process is given hereinunder in which the event frame EF is transferred and written to the area 38*a* of the RAM 38.

Figure 7:
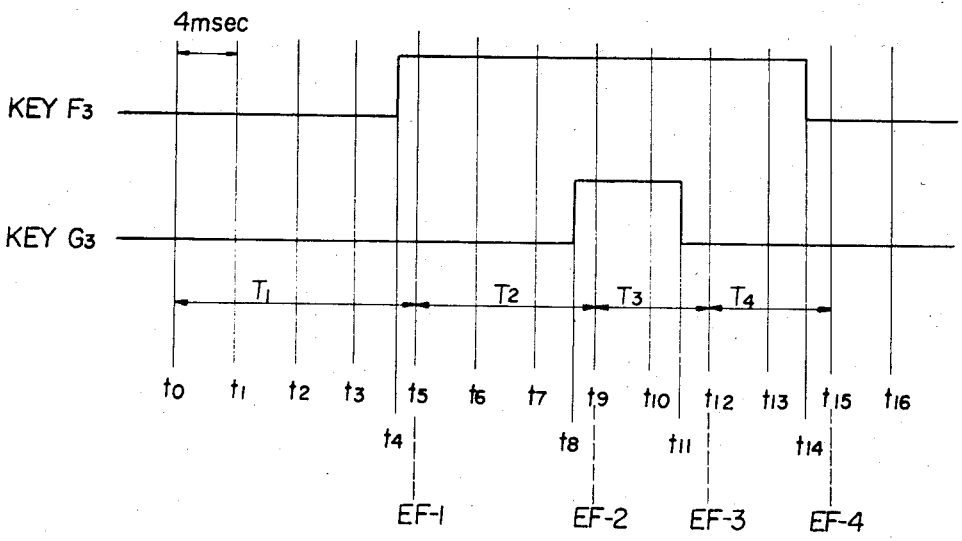
FIG. 7 is a timing chart showing an example of a key operation.

It is assumed here for the exemplary purpose of explanation that in FIG. 7 the start switch is actuated to make it on at timing $t_0$; the key switch K2 of a key F3 (corresponding to a note F of the third octave) is turned on at a timing $t_4$; the key switch K2 of a key G3 (corresponding to a note G of the third octave) is turned on at a timing $t_8$; the key switch K1 of the key G3 is turned off at a timing $t_{11}$; and the key switch K1 of the key F3 is turned off at a timing $t_{14}$.

Figure 8:
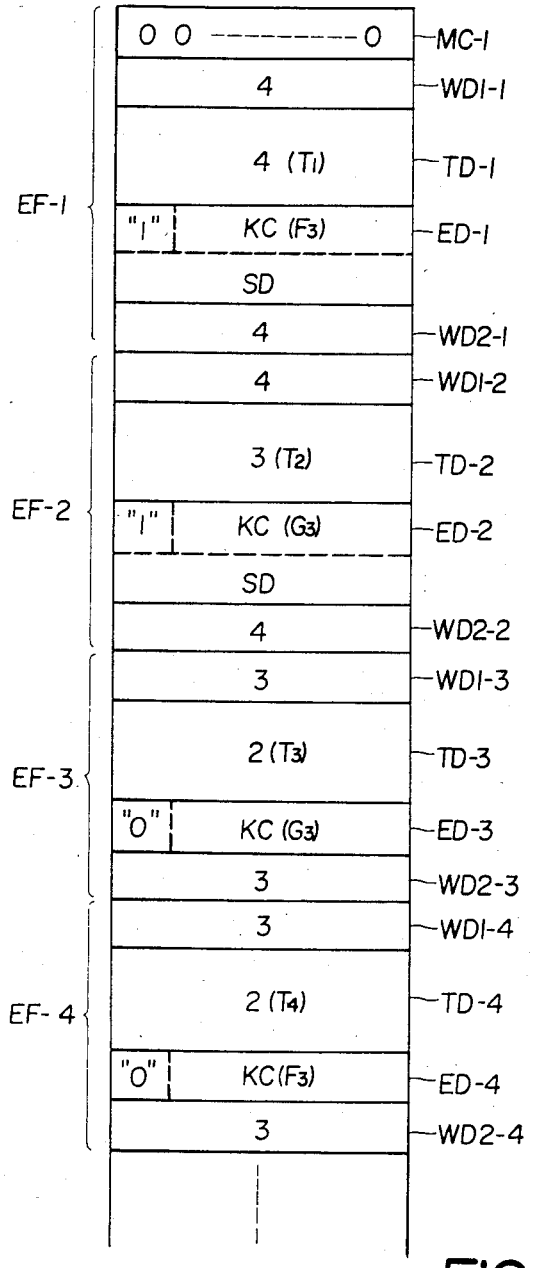
FIG. 8 shows a sequence of data stored in the RAM 38 in FIG. 2 which data is generated in response to the key operation shown in FIG. 7.

After the start switch is turned on at a timing $t_0$, the control signals SS are generated at 4 ms time intervals at the timings $t_1$, $t_2$, and $t_3$. Since there is no change of the key depression during the period from the timing $t_1$, to the timing $t_3$, an event is not detected. However, at a timing $t_5$ an event is detected because a state showing the depression of the key F3 appears at that timing which differs from that at the timing $t_3$. As a result, an event frame EF-1 shown in FIG. 8 is written to the area 38*a* of the RAM 38. Thus, the contents of the timer data TD-1 is "4" in decimal notation (corresponding to the time period Tl shown in FIG. 7), the contents of the event data ED-1 are those of the key code KC, key striking strength data SD, both of the key F3, and key-on code "1", and the contents of the first and second word number data WDl-1 and WD2-1 are both "4" in decimal notation.

Although the process of event detection is also carried out at timings $t_6$ and $t_7$, no event is detected at the timing $t_6$ and $t_7$ to thereby generate no event frame EF. Under the event detection process at a timing $t_9$, an event is detected due to the change of the depression state of the key G3. Therefore, an event frame EF-2 shown in FIG. 8 is written to the area 38*a* of the RAM 38 following the location where the event frame EF-1 has been stored. The similar process is followed repeatedly, and at a timing $t_{12}$ an event is detected due to the change of the depression state of the key G3 so that an event frame EF-3 shown in FIG. 8 is written to the area 38*a* of the RAM 38. Similarly, at a timing $t_{15}$ an event is detected due to the change of the depression state of the key F3 so that an event frame EF-4 shown in FIG. 8 is written to the area 38*a*.

As appreciated from the above embodiment, every time an event is detected the musical performance data (timer data TD and event data ED) is recorded to the area 38*a* of the RAM 38 as a format of an event frame EF. After the area 38*a* is completely filled up with the event frames EF, the vacant area 38*b* is used for storing the succeeding event frames EF. In addition, the data stored in the area 38*a* is supplied to the floppy disk driver 22 and is sequentially written to the available tracks of the floppy disk thereof via the floppy disk controller 49 under the control of a direct memory access controller 50. In the case when the area 38*b* is completely filled up, the event frame EF is then stored in the new area 38*c*, and the data stored in the old area 38*b* is transferred and written to the predetermined tracks of the floppy disk. The areas 38*a*, 38*b*, and 38*c* are thus cyclically utilized. The above description so far has been concerned in the processes how the musical performance data obtained from the performance of a piano player is recorded and stored in the floppy disk of the floppy disk driver 22.

In the course of storing various musical performance data of a plurality of musical programs in the tracks of the floppy disk, there is provided an additional data processing stage for the convenience of easy access to the musical performance data of a specified musical program.

Figure 9:
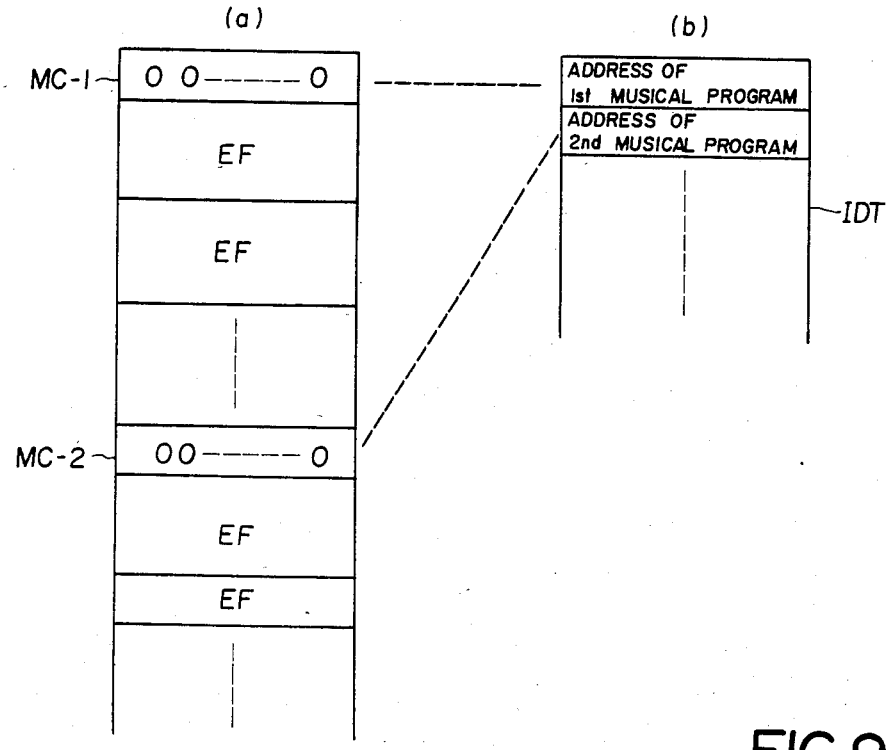
FIGS. 9*a* and 9*b* are diagrammatic illustration relating to an index table IDT for use in identifying the the number of a musical program.

More specifically, upon depression of the start switch, a musical program intermediate code MC-1, all of the digits of which are composed of a bit "0" as shown in FIG. 9(*a*), is written to the first position of a location in the area 38*a* of the RAM 38. Thereafter, succeeding the program intermediate code MC-1, the event frames EF are sequentially written to the area 38*a* every time an event is detected. A reference character MC-1 used in FIG. 8 also shows such a program intermediate code. After completing the performance of the first musical program, the player again depresses the start switch to perform a second musical program. Similarly, a program intermediate code MC-2 is written to the area 38*a* (or to the area 38*b* or 38*c*), and the event frames EF are written thereafter. The same process is repeated when the following musical programs, third, fourth, and so on are repeated. In this case, the depression of the stop switch by the player after completion of each musical program causes the data stored in the areas 38*a* through 38*c* to be written to the tracks of the floppy disk of the floppy disk driver 22. Then, addresses each identifying a specific location in the tracks of the floppy disk of the floppy disk driver 22 and corresponding to the respective program intermediate code are written to a specified track in the floppy disk, sequentially in the order starting from the first musical program. As a result, an index table IDT as shown in FIG. 9(*b*) is formed to be stored in the floppy disk. Thus, in this embodiment, an easy access to a specified musical program is attained by placing the program intermediate code at the top of the event frames EF of each musical program and by forming the index table IDT in the floppy disk.

(II) Musical Performance Data Reproducing or Automatic Piano Playing

The process for storing a musical performance data in the floppy disk of the floppy disk driver 22 has been described under the title (I) "Musical Performance Data Recording". Next, the process for reading out thus stored musical performance data and automatically playing the piano in accordance with the stored data will be described hereinunder.

The operator first actuates the read command switch on the operating keyboard 43, and specifies the musical program number allocated to each musical program by depressing the numerical character keys and thereafter the operator makes the depression of the start switch.

Upon depression of the start switch, the CPU 35 reads out the address (that of the program intermediate code), corresponding to the musical program number specified by the depression of the numerical character keys, from the index table IDT (refer to FIG. 9(*b*)) stored in the tracks in the floppy disk of the floppy disk driver 22. The read-out address is again supplied through the floppy disk controller 49 to the floppy disk driver 22 in order to transfer the data stored in the location after the read-out address to the areas 38*a* through 38*c* having a capacity of 12K words. After the above process, the CPU 35 generates the repetition data BD designating a 4 ms time interval, as similar to the process described in the data recording processes, so as to supply it to the control signal generating circuit 41. The control signal generating circuit 41 accordingly generates the control signals SS of 4 ms time intervals to supply them to the CPU 35. The data transferred to the areas 38*a* through 38*c* is then processed sequentially by the control signals SS under the control of CPU 35. This data processing will be described hereinunder assuming, for the purpose of convenience, that as shown in FIG. 8 the program intermediate code MC-1, event frames EF-1, EF-2 . . . . . are stored in the area 38*a* at from the first position of the location thereof in the above order.

After supplying the repetition data BD designating a 4 ms time interval to the control signal generating circuit 41, the CPU 35 reads out the first word number data WDl-1 (the contents being "4") and timer data TD-1 (the contents being "4") from the area 38*a* of the RAM 38 to transfer both of them respectively to a temporary storage area SPE and timer area TE in the area 38*d*. The contents of the timer area TE is subtracted by "1" and the result is again written to the timer area TE, every time the control signal SS is generated. At the time instant when the contents of the timer area TE becomes "0", that is, after the lapse of a time duration Tl shown specifically in FIG. 7, the following processes are carried out.

(a) The number of words "4" in the first word number data WDl-1 is subtracted by the number of words "2" in the timer data TD.

(b) The subtracted result, which indicates the number of words "2" of the event data ED-1 in FIG. 8, determines the number of data words to be read out of the area 38*a*. The read-out data, i.e., the event data ED-1 is written to the event data area EDE in the area 38*d*.

(c) The first word data number WDl-2 (the contents is "4") and timer data TD-2 (the contents is "3") as shown in FIG. 8 are read out of the area 38*a* to respectively write them to the temporary storage area SPE and timer area TE in the area 38*d*.

Upon completion of the write operation of the event data ED-1 to the event data area EDE in the area 38*d* (the process described in the above (b)), a solenoid driving data SKD is formed in compliance with the event data ED-1 (i.e., a key code KC corresponding to the key F3, key striking strength data SD, and key-on code "1"), and is supplied to the solenoid driving circuit 23. The solenoid driving circuit 23 generates a solenoid driving signal in accordance with the solenoid driving data SKD to supply it to the solenoid 47 corresponding to the key F3 via the amplifier 46. Thus, the key F3 is struck with a strength proportionate to the key striking strength data SD. The process for driving the solenoid 47 will be later described more specifically.

Following the process (c) above, the contents of the timer area TE (at this instant, the contents is "3") is subtracted by "1" every time the control signal SS is generated, until the contents of the timer area TE becomes "0" (i.e., after the lapse of a time duration T2 shown in FIG. 7). Thereafter, the similar processes as described above are performed:

(a) The number of words "4" in the first word number data WDl-2 is subtracted by the number of words "2" in the timer data TD.

(b) The event data ED-2 is read out of the area 38*a* in accordance with the subtracted result "2", and is written to the event data area EDE.

(c) The first word number data WDl-3 ("3") and timer data TD-3 ("2") are read out of the area 38*a* to respectively write them to the temporary storage area SPE and timer area TE.

Upon completion of the write operation of the event data ED-2 (i.e., a key code KC corresponding to the key G3, key striking strength data SD, and key-on code "1") to the event data area EDE, the solenoid 47 corresponding to the key G3 is driven in accordance with the contents of the event data ED-2.

After the lapse of a time duration T3 corresponding to the contents "2" of the timer data TD-3, the similar processes as in (a) through (c) above are performed with a result that the event data ED-3, timer data TD-4 ("2"), and first word number data WDl-4 are written to the respective event data area EDE, timer area TE, and temporary storage area SPE. Upon completion of the write operation of the event data ED-3 (i.e., a key code KC corresponding to the key G3, and key-off code "0") to the event data area EDE, the solenoid 47 corresponding to the key G3 is turned off.

The same processes are repeated to automatically play the piano. When the whole data transferred to the area 38*a* of the RAM 38 is fully read out and is reproduced automatically by the piano, the automatic playing is continued by reading out the succeeding data stored in the next area 38*b*. During the time the data in the 38*b* is read out and reproduced automatically by the piano, the empty location of the area 38*a* is filled up by reading out the following data from the tracks in the floppy disk of the floppy disk driver 22 and by writing it thereto. Thus, after the automatic performance according to the data in the area 38*b* is completed, it is continued sequentially by reading out the data in the order of the areas 38*c*→38*a*→38*b*→. . . , while the write operation of the musical performance data is continued sequentially according to the order of the areas 38*b*→38*c*→38*a*→. . . , after completion of the writing operation to the area 38*a*.

It is to be noted here that although the above description has been limited to the operation originated from the actuation of the keys of the keyboard 20, the operation with respect to the pedals of the pedal device 21 may also be applied in the same way.

In the event that it is desired to change the tempo of musical performance, the repetition data BD representing such as a 3 ms or 3.5 ms time interval may be used for supplying it to the control signal generating circuit 41, in lieu of the repetition data BD representing a 4 ms time interval as above.

The process for driving the solenoid 47 in accordance with the event data ED stored in the event data area EDE will now be described below, assuming that the key F3 is driven exemplarily.

First, the key striking strength data SD stored in the event data area EDE is transformed in compliance with a conversion table for the key striking strength data and correction table for the key striking strength data, resulting in a new data which is referred to as a key striking strength data HSD.

The reason to transform the key striking strength data SD into the key striking strength data HSD is that:

(a) The key striking strength data SD has the contents proportionate to the key striking strength exerted by the player, while the plunger response speed of the solenoid 47 does not follow linearly to the pulse width of the solenoid driving signal. In other words, although the solenoid driving signal with a pulse width proportionate to the key striking strength data SD is supplied to the solenoid 47, the plunger response speed will not become in proper proportion to the key striking strength. The key striking strength data SD must therefore be transformed to the new key striking strength data HSD having the plunger response speed corresponding correctly to the key striking strength data SD.

(b) It is required to change the key striking strength data between the black and white keys because the weight of each key differs from each other.

(c) Some cases occur in which all of the solenoids 47, 47 . . . can not be aligned in a straight line due to a restricted space for accommodating the solenoids. In such occasions, the key striking strength data must be corrected in accordance with the position of the solenoid 47.

(d) The key striking strength data SD must also be corrected in proportion to the pitch of a musical note of each key (this correction is designated as key scaling in the art).

Figure 10:
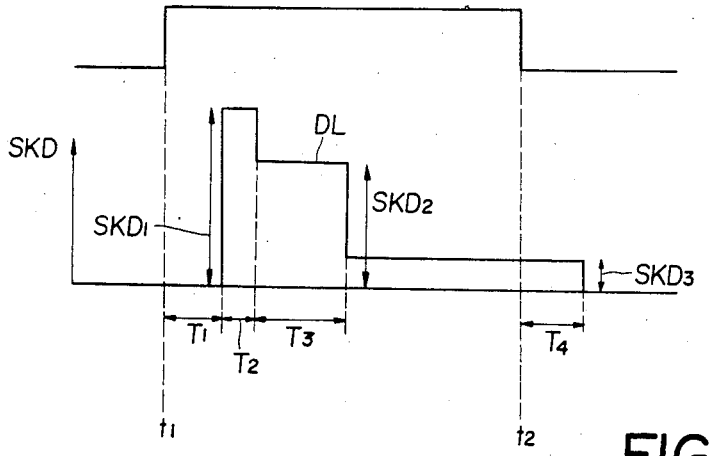
FIG. 10 is a graph illustrating the waveform of a solenoid driver data SKD in a time domain.

Basing upon the key striking strength data HSD, the solenoid driving data SKD is generated, the contents of which varies stepwisely from time to time as shown in FIG. 10 as DL. In the FIGURE, the time $t_1$ represents a time instant when the event data ED-1 is written to the event data area EDE, and the time $t_2$ represents a time instant when the event data ED-4 (refer to FIG. 8) is written to the event data area EDE. It is seen from FIG. 10 that the waveform of the solenoid driving data SKD is composed of three solenoid driving data $SKD_1$ through $SKD_3$ each of which is specifically referenced to time durations $T_1$ through $T_4$. The meanings of these terms are defined in the following;

$T_1$ : an on delay time period required for properly compensating for the difference of strength of sounds. It is known in the art that if two different sounds in strength are simultaneously produced and recorded, the reproduction of these sounds results in that the weaker sound is delayed to be reproduced when compared with the stronger one. In order to eliminate such a problem, the time duration $T_1$ is set shorter for a weaker sound, and conversely longer for a stronger one.

$SKD_1$ : a data to be used for getting out of a static friction. That is, the solenoid driving data $SKD_1$ is converted to a solenoid driving signal to be supplied to the solenoid 47, whereby the plunger of the solenoid 47 is driven to a condition free from the static friction. (This data is particularly effective for reproduction of weaker sounds when the mechanical qualities of each solenoid become noticeable).

$T_2$ : a period of time required for getting out of a static friction.

$SKD_2$ : a data which corresponds to the key striking strength data HSD, the value of the contents of which determines the plunger response speed of the solenoid 47.

$T_3$ : a period of the time required for the plunger of the solenoid 47 to fully emerge therefrom, i.e., a period of time required for the key to fully turn on.

$SKD_3$ : a data for holding the solenoid, i,e., a data for maintaining the plunger of the solenoid 47 emerged as energized.

$T_4$ : an off delay time period. Since the on delay time period $T_1$ is set at the start of the data $SKD_1$, if the solenoid driving data $SKD_2$ is turned off at the time instant $t_2$, the period of the reproduction falls shorter than that of the real performance by the player. The off delay time period $T_4$ is provided in order to eliminate the above problem and is particularly effective in delivering a consecutive performance of the same musical tones.

The solenoid driving data $SKD_1$ through $SKD_3$ are supplied together with the key code of the key $F_3$, in sequential order at the timing shown in FIG. 10 to the solenoid driving circuit 23. The solenoid driving circuit 23 generates as previously described the solenoid driving signal having a constant time interval and a pulse width corresponding to the respective solenoid driving data $SKD_1$ through $SKD_3$, the solenoid driving signal being in turn supplied through the amplifier 46 to the solenoid 47 provided at the key $F_3$. Thus, the solenoid 47 is driven at a strength corresponding to the key striking strength data SD.

(III) Fast Forward

The term "fast forward" as used herein is intended to imply the same meanings as used in tape recorder technique. Specifically in this embodiment, the fast forward means an operation in which the data stored in the areas 38*a* through 38*c* of the RAM 38 is read out in the same sequential order as a musical program has been performed, and also with a higher speed than that of the automatic playing.

An operator activates a fast forward switch provided at the operating keyboard 43 in order to allow the CPU 35 to deliver the repetition data BD representing a 200μ sec time interval to the control signal generating circuit 41. Then, the control signal SS of a 200μ sec time interval is developed from the control signal generating circuit 41 to supply it to the CPU 35. The CPU 35 subtracts the data stored in the timer area TE by "1" at each time instant the control signal SS is generated and writes the subtracted result to the timer area TE once again. When the contents of the timer area TE is cleared to be "0", the timer data TD and first word number data WDl-1 of the event frame EF, both stored in the next location following the previously read out data, are read out of the areas 38*a* through 38*c* of the RAM 38 to write them respectively to the timer area TE and temporary storage area SPE. The above processes are repeated every time the control signal SS is generated until the operator activates the stop switch to stop the operation of the fast forward.

In the case of the fast forward operation, the timer data TD and first word number data WDl both stored in the areas 38*a* through 38*c* are read out, and then the contents of the former is counted at a 200μ sec interval to obtain the time indicated in the timer data TD. The latter is used for identifying the address of the next timer data TD to be read out by the CPU 35. It is to be noted here that the event data ED within the areas 38*a* through 38*c* is not subjected to a read operation for purpose of preventing an automatic piano playing. It is also the case in the fast forward operation that upon completion of reading out all the data of the timer data TD and first word number data WDl stored in the area 38*a* (38*b*, 38*c*), the succeeding data is transferred to the area 38*a* (38*b*, 38*c*) from the tracks in the floppy disk of the floppy disk driver 22 as in the automatic piano playing described previouly.

(IV) Fast Backward

The term "fast backward" as used herein is intended to imply the same meanings "rewind" in a tape recorder technique. Specifically in this embodiment, the fast backward means an operation in which the data stored the areas 38*a* through 38*c* of the RAM 38 is read out in the opposite sequential order to that a musical program has been performed, and also with a higher speed than that of the automatic playing.

An operator activates a fast backward switch provided at the operating keyboard 43 in order to allow the CPU 35 to deliver the repetition data BD representing a 200μ sec time interval to the control signal generating certuit 41. Then, the control signal SS of a 200μ sec time interval is developed from the control signal generating circuit 41 to supply it to the CPU 35. The CPU 35 subtracts the data stored in the timer area TE by "1" at each time instant the control signal SS is generated and writes the subtracted result to the timer area TE once again. When the contents of the timer area TE is cleared to be "0", the second word number data WD2 is read out of the preceding event frame ED, i.e., in other words the sequence of read-out operation of the data WD2 is carried out oppositely to the stream of musical performance. The address of the timer data TD of the preceding event frame is then determined by the second word number data WD2. With the address thus identified, the timer data TD of the preceding event frame EF is read out and written to the timer area TD of the RAM 38. The above processes are repeated every time the control signal SS is generated until such a time as the operator activates the stop switch to stop the operation of the fast backward.

In the case of the fast backward, the timer data TD stored in the areas 38*a* through 38*c* is read out in the opposite sequence to the stream of musical performance, the contents of the read-out timer data TD is counted at a 200μ sec interval to obtain the time indicated in the timer data TD. Similarly to the above fast forward operation, the event data ED is not subjected to a read operation in order to prevent performing an automatic piano playing.

As seen from the above detailed description, since there is provided key striking strength detection means for detecting the key striking strength of each depressed key and for generating the corresponding key strength data, the key striking strength of each key can be recorded independently and separately even when a plurality of musical tones are produced. Furthermore, the present invention has an effect to enable the use of storage devices having a smaller capacity than that which would have been required otherwise, because the recording process into the storage device is carried out only when the depressed or released state of the key and or pedal is changed.

What is claimed is:

1. A system for recording musical performances for an automatic playing musical instrument comprising:

a plurality of keys;

key information generating means for generating key information data corresponding to depressed keys among said plurality of keys, said key information generating means including first shift register means for storing data representing the identity of each depressed key, second shift register means for storing data representing the strength with which said key was struck and third shift register means for storing data indicating that said key has been completely depressed;

change detecting means for detecting a change of said key information data;

measuring means for measuring the time interval between successive changes in said key information data and generating a time period data representative of said time interval;

storing means for storing, each time one of said changes is detected, a musical performance data comprising said key information data and said time period data.

2. An automatic playing musical instrument as claimed in claim 1, wherein said plurality of keys include a pedal key.

3. An automatic playing musical instrument as claimed in claim 1, wherein said change detecting means comprises first memory area for storing present key information and second memory area for storing previous key information, whereby said change detecting means compares the contents of said first and second memory areas in order to detect said change of key information.

4. An automatic playing musical instrument as claimed in claim 1, wherein said measuring means comprises clock pulse generating means for generating pulses having a predetermined repetition frequency, said measuring means counting said pulses between one of said change and the other which follows immediately after said one of the change, and the number of said counted pulses corresponding to said time period data.

5. A system for recording musical performances for an automatic playing musical instrument comprising:

a plurality of keys;

key information generating means, having a small plurality of channels, for continuously generating key information data corresponding to depressed keys among said plurality of keys, each of said depressed keys being assigned to one of said channels;

change detecting means for detecting a change in said key information data, said change detecting means comprising:

(i) memory means having a first and second memory areas, (ii) a clock pulse generator for generating clock pulses at regular intervals, (iii) means for writing data from all channels of said generating means which contain key information data of completely depressed keys into said first memory area upon the occurrence of each clock pulse, (iv) means for detecting any difference between said key information data written into said first memory area and key information data previously stored in said second area, and (v) means for then transferring said key information data written into said first memory area to said second storage area and for discarding key information data previously stored in said second memory area;

counting means for counting the number of said clock pulses since the last detection of a difference in said key information data;

a third memory area in said memory means for storing the count of said counting means; and event frame establishing means for transferring the key information data stored in said first memory area and the count stored in said third memory area to a fourth memory area in said memory means upon the detection of one of said differences.

6. A system for recording musical performances according to claim 5 and further including:

a fifth memory area in said memory means for alternating use with said fourth memory area for storing said key information data and said counter data from said first and third memory areas upon detection of one of said differences, said fifth memory area being used to record key information data and counter data from said first and third memory areas after said fourth memory area is filled to capacity; and means for transferring data from said fourth and fifth memory areas to disk memory means after the respective memory area has been filled to capacity and during the time when the other of said memory areas is recording data.

7. In a system for recording a musical performance for an automatic playing musical instrument, the improvement comprising;

memory means for storing musical performance data;

event frame recording means for recording said musical performance in memory means as a plurality of successive event frames, each event frame comprising timer data representing the elapsed time since the previously recorded event frame, and key information data including at least key identification data, and word number data recording means, cooperating with said event frame recording means, to record in said memory means a first word at the start of each event frame, said first word containing number data indicating the total number of data words included in said event frame.

8. A system for recording a musical performance according to claim 7 wherein said event frame includes key striking strength data as well as key identification data.

9. A microprocessor controlled system for recording performance data of a keyboard musical instrument, comprising:

control signal generating means for generating control signals at a regular clock rate, said microprocessor being operative in response to each occurrence of said control signals to perform a sequence of events including:

(a) comparison of data designating all currently depressed keys of said instrument with like data representing which keys were depressed upon the last prior occurrence of said control signal, and (b) in the event a difference is detected by said comparison operation, of establishing an event frame of data including the new depressed key data and an event time, and counter means for counting said control signals, the contents of said counter means comprising said event time, and, in the case where difference is detected, said microprocessor thereafter clearing said counter means before occurrence of the next control signal.

10. A system according to claim 9 wherein said data designating currently depressed keys comprises, for each depressed key, a key code identifying such depressed key, key strength data indicating the strength with which said key was depressed, and a key depression acknowledgement signal which becomes true only after key depression is completed, said microprocessor performing said comparison only with respect to depressed key data for which the corresponding key depression acknowledgement signal is true.

11. A system according to claim 9 wherein said microprocessor, in establishing said event frame, incorporates within said event frame a word designating the total number of data words contained within such event frame.

12. A system for recording musical performances for an automatic playing musical instrument comprising:

a plurality of keys;

key information generating means for generating key information data corresponding to depressed keys among said plurality of keys, said key information generating means including first means for storing data representing the identity of each depressed key, second means for storing data representing the strength with which said key was struck and third means for storing data indicating that said key has been completely depressed;

change detecting means for detecting a change of said key information data;

measuring means for measuring the time interval between successive changes in said key information data and generating a time period data representative of said time interval;

storing means for storing, each time one of said changes is detected, a musical performance data comprising said key information data and said time period data.

* * * * *